US009683272B2

(12) United States Patent
Trummer et al.

(10) Patent No.: US 9,683,272 B2
(45) Date of Patent: Jun. 20, 2017

(54) GAS PURGING ELEMENT AND ASSOCIATED GAS FEED LINE

(71) Applicant: REFRACTORY INTELLECTUAL PROPERTY GMBH & CO. KG, Vienna (AT)

(72) Inventors: Bernd Trummer, Graz (AT); Michael Klikovich, Hinterbruhl (AT); Roman Kulp, Vienna (AT); Leopold Kneis, Grimmenstein (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 196 days.

(21) Appl. No.: 14/411,865

(22) PCT Filed: Aug. 7, 2013

(86) PCT No.: PCT/EP2013/066531
§ 371 (c)(1),
(2) Date: Dec. 29, 2014

(87) PCT Pub. No.: WO2014/032923
PCT Pub. Date: Mar. 6, 2014

(65) Prior Publication Data

US 2015/0184265 A1 Jul. 2, 2015

(30) Foreign Application Priority Data

Aug. 27, 2012 (EP) ..... 12181902

(51) Int. Cl.

| | |
|---|---|
| ***C21C 5/48*** | (2006.01) |
| ***F27D 3/16*** | (2006.01) |
| ***C21C 5/35*** | (2006.01) |
| ***C21C 7/072*** | (2006.01) |
| ***B22D 1/00*** | (2006.01) |
| ***C21C 5/34*** | (2006.01) |

(52) U.S. Cl.
CPC ..... *C21C 5/48* (2013.01); *B22D 1/002* (2013.01); *C21C 5/34* (2013.01); *C21C 5/35* (2013.01); *C21C 7/072* (2013.01); *F27D 3/16* (2013.01)

(58) Field of Classification Search
CPC ..... B22D 1/005; B22D 1/002
USPC ..... 266/220
See application file for complete search history.

(56) References Cited

U.S. PATENT DOCUMENTS

| | | | |
|---|---|---|---|
| 3,834,685 | A | 9/1974 | Torrence et al. |
| 4,616,809 | A | 10/1986 | Hoeffgen |
| 4,900,357 | A | 2/1990 | Bates |
| 5,112,029 | A | 5/1992 | Lazcano-Navarro et al. |

(Continued)

FOREIGN PATENT DOCUMENTS

| | | | |
|---|---|---|---|
| AT | 365958 | B | 2/1982 |
| DE | 3833502 | A1 | 4/1990 |

(Continued)

OTHER PUBLICATIONS

International Search Report for App. No. PCT/EP2013/066531 filed Aug. 7, 2013.

*Primary Examiner* — Scott Kastler
(74) *Attorney, Agent, or Firm* — Medley, Behrens & Lewis, LLC

(57) ABSTRACT

The invention relates to a gas purging element at a metallurgical vessel as well as a corresponding gas supply pipe.

8 Claims, 5 Drawing Sheets

(56) References Cited

U.S. PATENT DOCUMENTS

Figure 1:
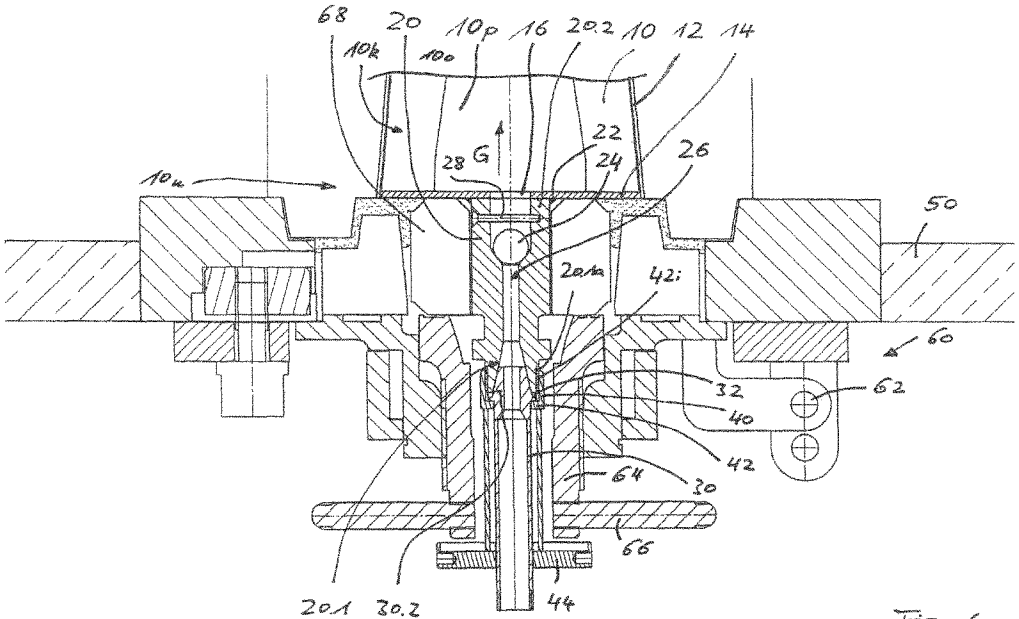

| | | | | |
|---|---|---|---|---|
| 5,312,092 | A * | 5/1994 | Decker | B22D 1/005 266/220 |
| 2008/0122145 | A1 | 5/2008 | Munding et al. | |
| 2015/0184265 | A1 * | 7/2015 | Trummer | B22D 1/002 266/217 |

FOREIGN PATENT DOCUMENTS

| | | | |
|---|---|---|---|
| EP | 0148337 | A1 | 7/1985 |
| EP | 0234852 | A1 | 9/1987 |
| WO | 2005107979 | A1 | 11/2005 |
| WO | 2011118477 | A1 | 9/2011 |

* cited by examiner

GAS PURGING ELEMENT AND ASSOCIATED GAS FEED LINE

The invention relates to a gas purging element at a metallurgic vessel as well as a corresponding gas supply line.

The gas purging element, also called gas purging plug, serves the blowing in of gases, if applicable also gas/solid mixtures, into a melt which is to be treated, especially a metallurgical melt. In the process the gaseous treatment fluid is led along corresponding channels/slits in a gas purging plug with directed porosity and along a corresponding irregular pore volume in a gas purging plug with random porosity.

The arrangement of a gas purging plug in the base or in the wall of a metallurgic vessel can take place in different ways. At a typical assembly the gas purging plug is arranged in a corresponding well block. On the outside, at the end where the gas is supplied, the purging element is secured at the metallurgic vessel by the means of a mechanism. For the dismounting or rather the replacement of the purging element, the mechanism is opened.

According to EP 0 148 337 A1, a ring of fireproof material belongs to this mechanism, which surrounds the gas supply pipe of the gas purging plug and radially overlaps the base of the gas purging plug.

Such gas purging plugs and corresponding assembly devices have proved themselves in the past. But a problem lies in the fact, that the effort to dismount/mount a gas purging elements is high, takes a long time, and causes relatively high costs.

In order to prevent a diffusion of the gas into the adjacent fireproof (refractory) material it is known to design the gas purging plug with a metal sheet coat. The metal sheet extends itself particularly circumferential and in the base area of the purging element. The base metal sheet features an opening, to which a gas connection pipe is connected, which freely protrudes the base metal sheet. This segment is called the "cold end" of the gas purging plug, while the opposite end—in axial direction—of the gas purging element is called "hot end". After the assembly of the gas purging element this end is functionally in contact with the hot melt which is to be treated. Gas is blown into the melt via the gas connection pipe, the opening and the directed and/or random pores of the fireproof material.

DE 38 33 502 02 suggests a gas purging plug, which does not feature a metallic base plate and no gas supply adapter. This gas purging plug is characterized by a free opening at the cold end. A mounting device secures the gas purging plug in the mounting position und also serves the purpose to insert a gas connection element, in order to lead the gas from there through the gas purging plug.

It is easy to transport and mount, the gas purging plug according to DE 38 33 502 C2, because it does not feature the long gas supply pipe like the gas purging plug according to EP 0 148 337 A1. But it is hardly possible to seal the mentioned device according to DE 38 33 502 02 against a loss of gas.

The object of the present invention is to offer a constructively easy option to make the mounting or rather the dismounting of a gas purging plug easier and to minimize a loss of gas.

The invention starts from the following thought: A gas purging plug coated with a metal sheet has many advantages. It has a high fitting accuracy, prevents a loss of gas and is sturdy during transport. The latter is valid with limitations regarding the gas supply pipe.

Insofar an inventive aspect is to reduce the length of the gas supply pipe to a minimum, so only to design a short gas supply adapter.

One or more elements such as pipes, adapters or the like can be connected to this gas supply adapter in order to provide as gas connection between the gas source and the gas purging plug.

In the context, a further inventive idea is to plug such an element and the gas supply adapter into each other, so as to design a push-fit (plug-and-socket) connection.

"Push-fit connection" (plug and socket connection) means that corresponding segments of adjacent elements are only plugged into each other in order to achieve the desired fluidic, preferably lossfree flowing through of the gas. According to common terminology the push-fit connection includes a male part and a female part. The concrete geometry is not decisive.

The push-fit connection offers the possibility to connect adjacent segments (of the gas supply system) with each other in the direction of the gas flow just by plugging. In doing so only the push-fit connection serves the purpose to create a generally gastight connection. This connection can for example be realized by the fact that corresponding segments of the push-fit connection are correspondingly designed conically/frustoconically and plugged into each other.

Therefore the push-fit connection mainly serves the gas tight connection of adjacent elements (for example pipe segments), optionally a further securing element can mechanically secure/fix adjacent segments in the plug-position in place.

The push-fit connection does not require any tools, the parts of the "gas pipe" which are to be connected are simply plugged (fit) into each other. This is done quickly even at high temperatures in the surrounding.

In its most general embodiment, the invention relates to a gas purging element at a metallurgical vessel with the following features:

a) A ceramic fireproof body with a first end and a second end,
b) The second end is in the assembled state of the gas purging element in contact with a metal melt
c) The first end is covered by a metal coat on the outside, which features an opening, to which a gas supply adapter is connected,
d) The gas purging element, the body and the gas supply adapter are designed in such a way that a treatment gas which is supplied via the gas supply adapter flows through the body and exits the body at its second end,
e) The gas supply adapter is connected to the metal coat und designed as a male or female part of a push-fit connection for the connection with a corresponding female part or a corresponding male part of a gas supply pipe.

The gas supply adapter in the base of the gas purging element can be designed according to the type of an adapter. This adapter differs from a gas supply pipe of the known type. The adapter can be much shorter and generally only has the purpose the provide a connection point for the gas supply pipe. Even though gas is necessarily led through this adapter, this is only done over a short distance. According to one embodiment the length of the adapter in the direction of the flow of gas is <20 cm, often <15 cm or <10 cm. The adapter connects directly to the base of the gas purging element.

The adapter/gas supply adapter can extend from the base metal sheet inwardly into the ceramic part of the gas purging plug or the opposite way, outwards. In both cases a corresponding gas supply pipe is plugged onto or into the gas supply adapter with its second end in order to create a continuous gas connection.

One embodiment suggests to connect the second end of the gas supply pipe and the adapter in the base area of the gas purging element via a push-fit connection and to secure it with an extra securing element against unintended disconnecting.

In the case of a freely protruding gas supply adapter a simple and detachable possibility of securing is to design the corresponding end segments of the plug elements with corresponding inner and outer screw threads (according to a cap nut), as it is shown in the Figures.

In place of the thread connection a bracket connection or a bajonet lock can also fulfill this task.

The mentioned segments of the connection (gas supply adapter/gas supply pipe) consist for example of pipe segments or hose segments, the inner cross section of which depends on the amount of gas, which is to be fed through the connection to the gas purging plug and afterwards through the gas purging plug.

There is the possibility to feature the gas supply adapter or the gas supply pipe with a break-through protection against invading (infiltrating) metal melt. For that purpose the relevant segment can feature a gas channel which is at least partially coiled or has a zigzag shape.

The break-through protection is therefore arranged in front of or at the cold end of the gas purging element (in direction of the stream of gas). The break-through protection can be constructed as a replaceable element which is connected to a corresponding segment of the gas supply pipe or the gas supply adapter, for example by the means of a push-fit connection of the named type.

As previously mentioned, the push-fit connection can be designed in such a way that the elements that are plugged into each other (especially pipe segments) feature corresponding geometries of the group: prisms, cones, frustocones, spheres, paraboloids.

The push-fit connection can specifically be designed in such a way that the free end of the segment, which is further away from the gas purging plug, features the largest cross section area, as it is displayed in the following description of the Figures.

While the push-fit connection allows a fast and secure gas tight connection of adjacent connection-segments, the securing element has the purpose to prevent that the connection disconnects again.

Insofar, the securing element can also be designed as a pressure or holding device, which for example pushes the gas supply pipe in the direction of the gas purging plug and holds it in the plugged in position.

Further segments of the gas supply pipe can be connected analogously.

The pressure/holding element can be part of a mounting device, which is swivel-mounted to the outside of the metallurgic vessel.

The mounting/dismounting device can be dimensioned in such a way that it can be swiveled freely over the gas supply adapter after the insertion of the gas purging element, whereby the mounting element features an opening or a slit through which the gas supply adapter and if relevant the gas supply pipe and the securing element can be led through.

According to the design of the mounting device, the length of the gas adapter (connection) element is chosen, which is part of the gas purging plug.

Further characteristics of the invention are revealed in the characteristics of the sub claims as well as the other application documents. The invention is further explained with respect to some embodiments hereinafter. It is shown—each in a schematic display—in FIG. 1: A longitudinal cross section through the base area of a metallurgical vessel with a first embodiment of a gas purging plug.

FIG. 2: Longitudinal cross sections through the base area of a metallurgical vessel with a second embodiment of a gas purging plug, wherein the individual mounting steps are shown separately.

In the Figures identical or similar elements are labeled with the same reference codes.

The reference code 10 describes a frusticonical gas purging plug with an outer metal sheet coat (metallic envelope) 12 and a metal sheet base 14, which features a central opening 16.

In the displayed mounted position, a fireproof ceramic body extends above said opening 16, with a porous segment 10*p*, through which a gas can be fed in direction of arrow G from the lower, cold end 10*u* of the gas purging plug 10 to its upper (not displayed) hot end 100.

Opposite the porous segment 10*p*, a gas supply adapter 20 for the gas purging plug 10 extends around the opening 16. The gas supply adapter 20 with an axial gas channel 26 extends itself in the displayed mounted position downwards from the opening 16.

The gas supply adapter 20 features a first end 20.1 at a distance to the gas purging element 10 and a second end 20.2 adjacent to the gas purging element 10. The second segment 20.2 is welded to the metal base 14 (weld seam 22).

In the area of the second end 20.2 the gas supply adapter 20 features a change in the cross-section on the inside, wherein the part which is facing the gas purging plug 10 has a larger cross section. In this segment a body 24 is loosely arranged. Without the gas pressure it rests on a shoulder of the described reduction of the cross section of the gas channel 26. Under the gas pressure the body 24 rises from the shoulder and moves in the direction of the gas purging plug. A securing bolt 28 which is arranged above the body 24 prevents that the body 24 blocks the opening 16.

At the first end 20.1 which is opposite, the gas channel 26 expands (widens) downwardly and outwardly in a cone like manner. Into this part, a second end 30.2 of a gas supply pipe 30 is plugged in a gas tight manner. This end 30.2 is correspondingly frustoconically (nozzle like) shaped and its tapered end lies on top. The end 20.1 forms the socket, the end 30.2 forms the plug of the push-fit connection.

In the mounted position the gas supply pipe 30 features a shoulder 32 on the outside a little below the first end 20.1 of the gas supply adapter 20. A ring shaped inner heel 42 of a securing element 40, which is also tube-shaped, rests against the shoulder 32. The securing element 40 features an inner (screw) thread 42*i* in the area above the heel 42, which is screwed onto a corresponding outer (screw) thread 20.1*a* of the first end 20.1 of the gas supply adapter 20, which first end is also cylindrical on its outside. Below the heel 42, the securing element 40 extends itself in a tube-shaped manner downwardly up until a radially to the outside running wheel 44 for fixation.

At this embodiment the connection of the gas supply adapter 20 and the gas supply pipe 30 is created by segments 20.1, 30.2 which are axially plugged into each other, wherein the push-fit connection is secured via the securing element 40 against loosening (opening).

A mounting device 60 is swivel-mounted to the outer coat 50 of the corresponding metallurgic vessel via a hinge 62 wherein FIG. 1 shows the mounted position in which the mounting device extends over the gas supply adapter 20 as well as the second end 30.2 of the gas supply pipe 30 with a ring shaped element 64. The ring shaped element 64 is fixed to the steady outer coat 50 in the displayed position with the aid of a handle 66. In doing so the element 64 touches a nozzle 68, which surrounds the second end 20.2 of the gas supply adapter 20. The nozzle 68 is part of the fireproof lining below the gas purging element 10. The first end 20.1 of the gas supply adapter 20 protrudes downwardly over said nozzle 68.

The mounting is simple, because the mounting device 60 can be swiveled in the described position, before the gas supply pipe 30 is stuck onto the gas supply adapter 20 and secured. Before the gas tight connection of said parts 20, 30 the gas purging plug 10 is securely positioned. The gas supply adapter 20 of the connection is precisely adjusted so that the push-fit connection with the gas feeding line 30 can take place very easily, accurately and fast. The length of the gas supply pipe 30 is arbitrary. The gas supply pipe 30 can also consist of multiple segments, which again may be connected in a gas tight manner by the means of a push-fit connection (or by other means).

This is also valid for the embodiment according to FIG. 2. It differs from the embodiment according to FIG. 1 mainly by the following characteristics:

The gas supply adapter 20 is designed in the way of an adapter, which is connected to the metal base 14 of the gas purging plug 10 (here: welded). The adapter only protrudes the base 14 downwardly by 10 mm and is designed at this end (20.1) similar to the first end 20.1 of the gas supply adapter 20 according to FIG. 1. Analogously this is valid for the second end 20.2 of the gas supply adapter 20 in FIG. 2. In other words: In the example according to FIG. 2 the gas connection adapter 20 and the connecting gas supply pipe 30 are connected via a push-fit connection.

The gas supply pipe 30 according to FIG. 2 is not designed as a pipe (as in FIG. 1) between the ends (30.1, 30.2) but as a thick-walled cylinder and simultaneously serves the purpose of a break-through protection. In order to do so the gas channel 26 is designed as a type of coil (or spiral) between the second end 30.2 and the first end 30.1. If metal melt enters the gas channel 26, it would be led radially to the outside (along the coil), thus the path for the melt is elongated, in order to be able to cool down the melt faster, until it solidifies. This is principally known and is here not explained any further.

The first end 30.1 of the gas supply pipe 30 according to FIG. 2 is designed analogously to the first end 20.1 of the gas supply adapter 20 according to FIG. 1 and serves the connection of a further gas supply pipe 70, which is designed analogously to the gas supply pipe 30 according to FIG. 1.

The ring shaped element 64 of the mounting device 60 directly touches the underside of the thick-walled part of the gas supply pipe 30 in its mounted position.

Figure 2A:
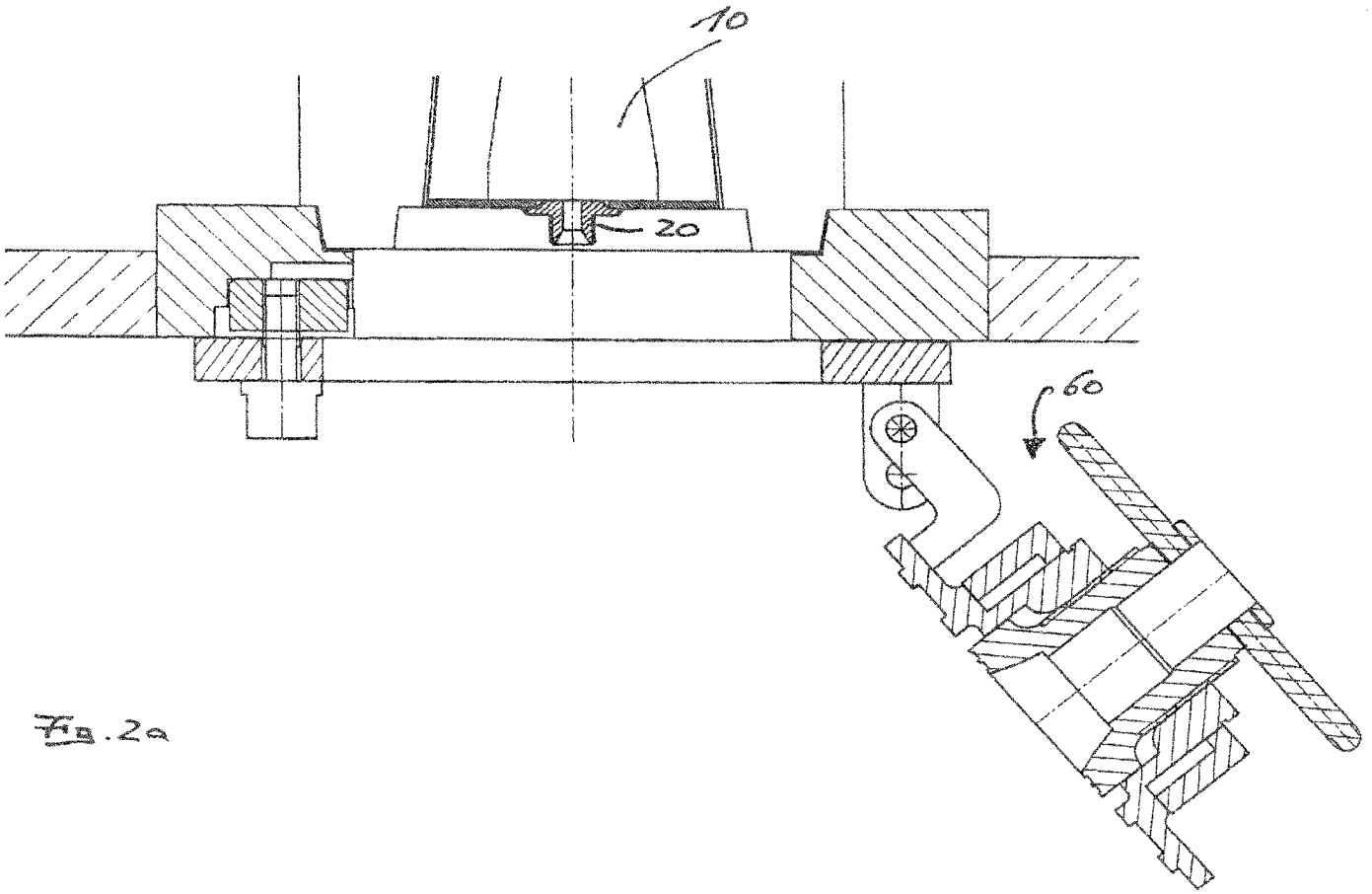

The FIGS. 2*a-d* shows the individual mounting steps for this embodiment. Firstly the gas purging plug 10 (with a connected adapter 20) is installed built into the base of the metallurgical vessel (FIG. 2*a*).

The mounting device 60 is open.

Figure 2B:
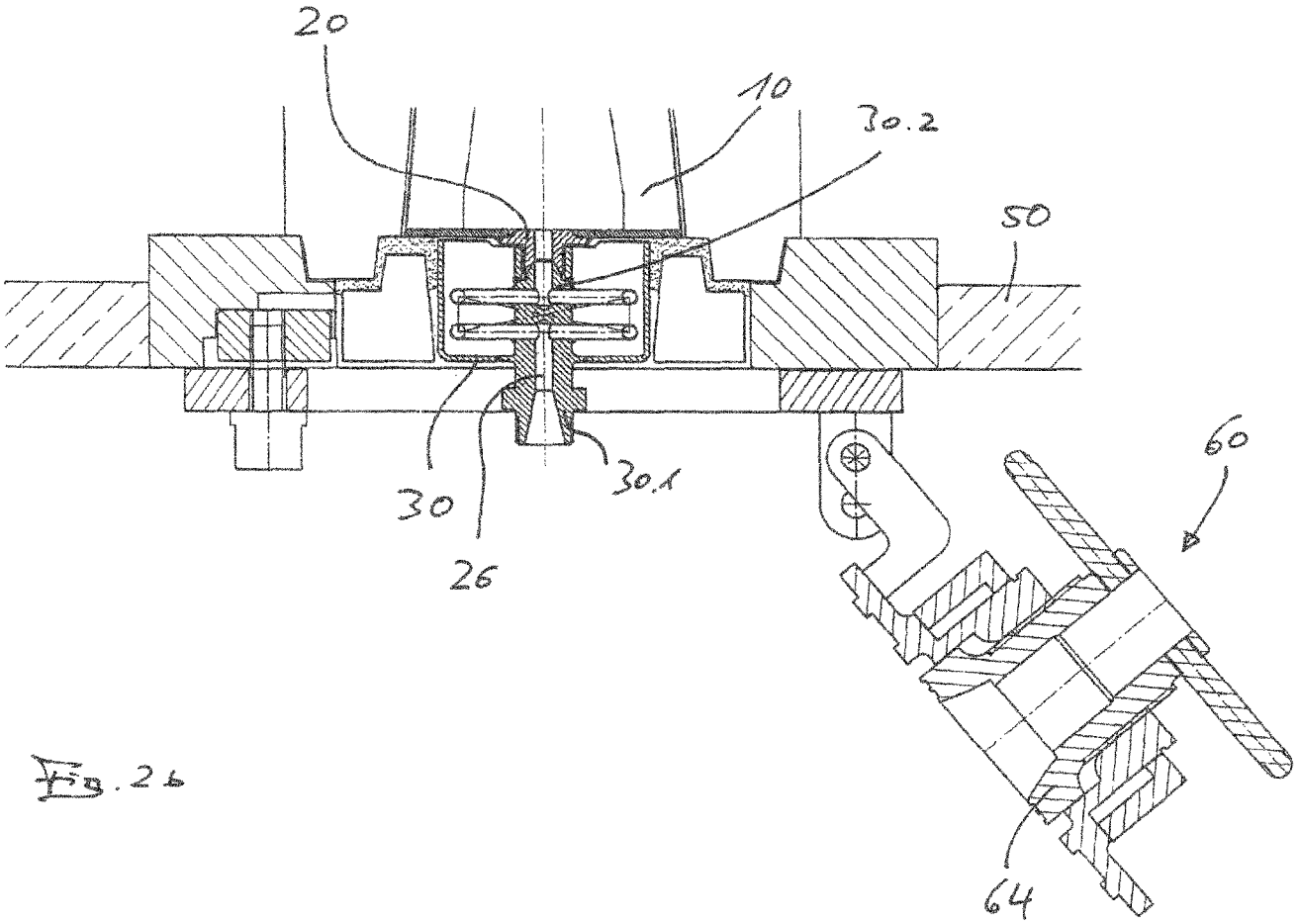
Figure 2C:
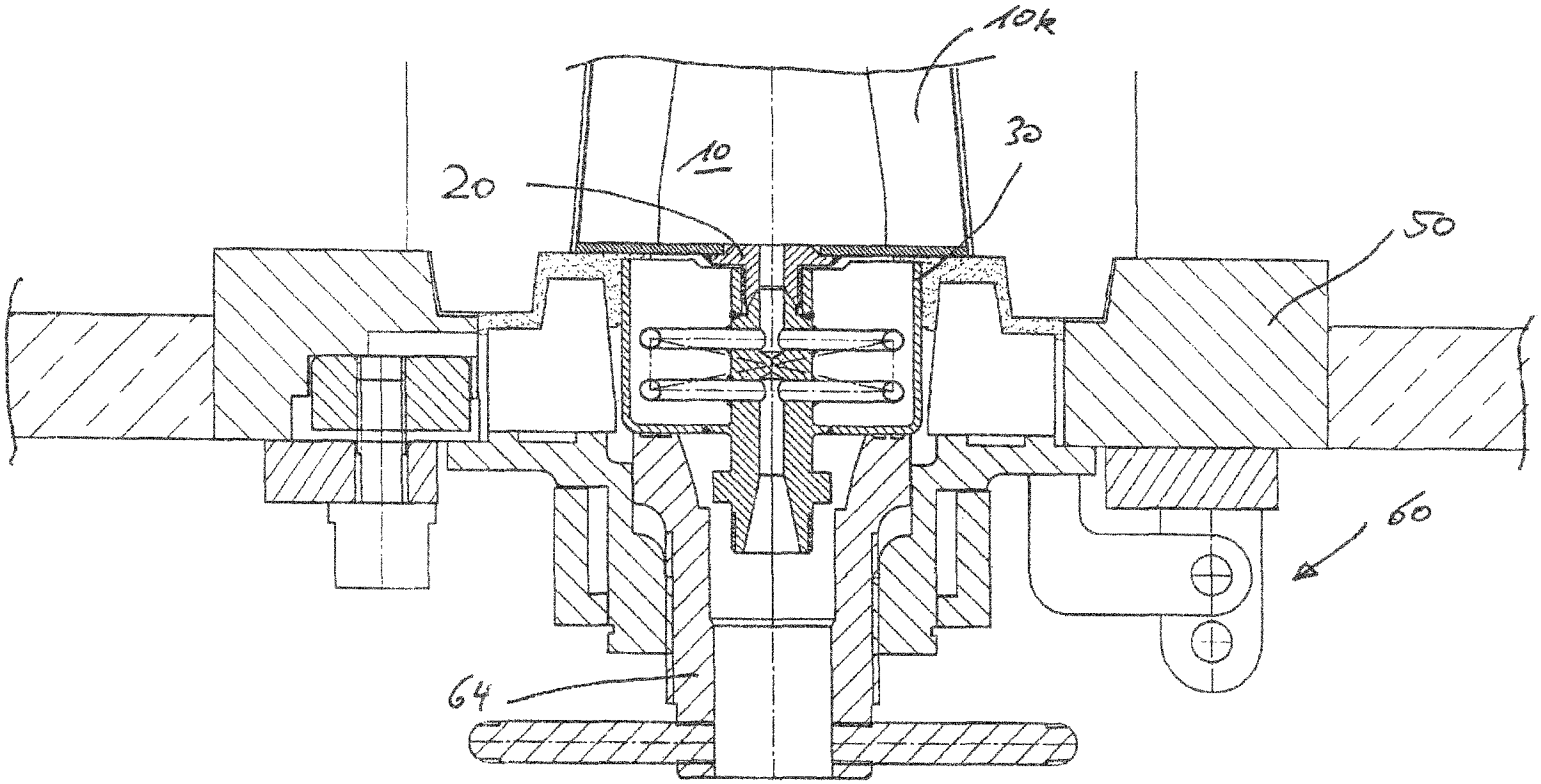

The gas supply pipe 30, including the break-through protection, is then stuck onto the adapter 20 and screwed together (FIG. 2*b*). Afterwards the mounting device is swiveled over both parts 20, 30 (FIG. 2*c*) and the part 30 secured.

Figure 2D:
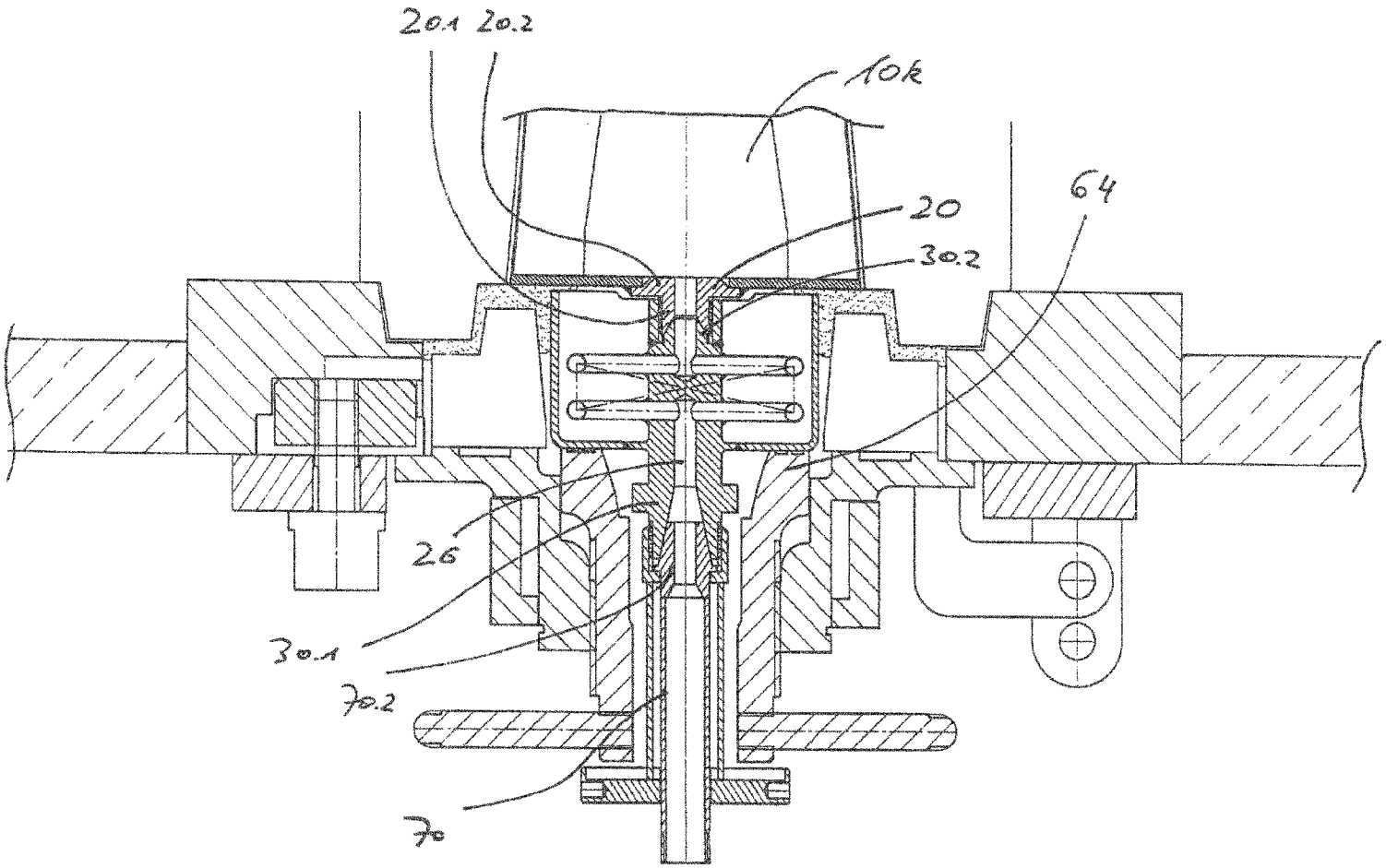

In the final step the further gas supply pipe 70 is stuck with its upper end 70.2 onto the lower segment 30.1 of the gas supply pipe 30 and secured via a screw-securing element, analogously as with the two ends 20.1, 30.2 (FIG. 2*d*).

The invention claimed is:

1. Gas purging device for metallurgical applications comprising a gas supply pipe (30) and a gas purging element (10), the gas purging device having the following characteristics:

a. the gas purging element (10) features a ceramic fireproof body (10*k*) with a first end (10*u*) and a second end (10*o*), b. the second end (10*o*) is in the mounted position of the gas purging element in contact with a metal melt, c. the first end (10*u*) is covered by a metal coat (12), which features an opening (16) to which a gas supply adapter (20) connects, the gas supply adapter (20) has a first end (20.1) and a second end (20.2), d. the gas purging element (10), the body (10*k*) and the gas supply adapter (20) are designed in such a way that a treatment gas which is supplied via the gas supply adapter (20) flows through the body (10*k*) and exits the body (10*k*) at the second end (10*o*), e. at the second end (20.2) the gas supply adapter (20) is connected via a gas connection area (22) to the metal coat (12), and at the first end (20.1) the gas supply adapter (20) is designed as a plug or as a socket of a push-fit connection for connection to a corresponding socket or a corresponding plug of the gas supply pipe (30), as well as f) a secure element (40) with an inner screw thread (42*i*), mechanically securing the push-fit connection according to a cap nut together with a corresponding outer screw thread at the first end (20.1) of the gas supply adapter (20).

2. Gas purging device according to claim 1, wherein the gas supply adapter (20) extends away from the ceramic body (10*k*), starting from the gas connection area (22) to the metal coat (12).

3. Gas purging device according to claim 1, wherein the gas supply adapter (20) extends towards the ceramic body (10*k*), starting from the gas connection area (22) to the metal coat (12).

4. Gas purging device according to claim 1, wherein the gas supply adapter (20), which is designed as a plug, features one of the following geometric shapes on the outside: cone, frustocone, prism.

5. Gas purging device according to claim 1, wherein the gas supply adapter (20), which is designed as a socket features one of the following geometric shapes on the outside: negative cone, negative frustocone, negative prism.

6. Gas purging device according to claim 1, wherein the gas supply adapter (20) features a break-through protection against invading metal melt.

7. Gas purging device according to claim 1, wherein the gas supply adapter features a back pressure valve (26, 28).

8. Gas purging device according to claim 1 whose gas supply adapter (20) features a length, in the direction of a stream (G) of the supplied gas, of less than 20 cm.

* * * * *